US005660751A

United States Patent [19]

O'Rorke et al.

[11] Patent Number: 5,660,751

[45] Date of Patent: Aug. 26, 1997

[54] BOWLING BALL REJUVENATOR

[76] Inventors: Blondale O'Rorke, Rte. 1, Box 510-0, Newalla, Okla. 74857; William A. Hall, 2829 SW. 49th, Oklahoma City, Okla. 73119

[21] Appl. No.: 458,562

[22] Filed: Jun. 2, 1995

[51] Int. Cl.[6] ..... H05B 1/00; F26B 21/00

[52] U.S. Cl. ..... 219/411; 219/386; 219/405; 432/124

[58] Field of Search ..... 219/385, 386, 219/405, 411, 201; 392/416, 418; 432/120, 121, 122, 124; 15/21.2

[56] References Cited

U.S. PATENT DOCUMENTS

| | | | |
|---|---|---|---|
| 2,572,464 | 10/1951 | Freitas . | |
| 2,617,012 | 11/1952 | Westley | 219/385 |
| 2,619,662 | 12/1952 | Hayes et al. . | |
| 3,086,233 | 4/1963 | Knott . | |
| 3,091,681 | 5/1963 | Mayer | 219/386 |
| 3,103,677 | 9/1963 | Gallant . | |
| 3,289,354 | 12/1966 | Stevens et al. . | |
| 3,341,982 | 9/1967 | Torresen . | |
| 3,402,415 | 9/1968 | Berlin . | |
| 3,445,876 | 5/1969 | Torresen . | |
| 3,460,179 | 8/1969 | Falckenberg et al. . | |
| 3,586,516 | 6/1971 | Terc | 219/400 |
| 3,624,346 | 11/1971 | Guth | 219/201 |
| 3,686,774 | 8/1972 | Beadle | 219/400 |
| 3,758,912 | 9/1973 | Shibuya et al. | 15/21.2 |
| 4,140,893 | 2/1979 | Renteria | 219/385 |
| 4,192,034 | 3/1980 | Knepper, Jr. . | |
| 4,486,639 | 12/1984 | Mittelsteadt | 392/416 |
| 4,690,977 | 9/1987 | Alden | 219/411 |
| 4,771,154 | 9/1988 | Bell et al. | 219/411 |
| 5,000,083 | 3/1991 | Pickave | 219/405 |
| 5,373,597 | 12/1994 | Worsham . | |

*Primary Examiner*—Teresa J. Walberg
*Assistant Examiner*—J. Pelham
*Attorney, Agent, or Firm*—Head, Johnson & Kachigian

[57] ABSTRACT

An apparatus to extract liquid absorbed in a bowling ball having a surface. The apparatus includes a closed chamber to receive the bowling ball therein. A heating element in the chamber increases the temperature of the ball in order to draw the liquid to the surface of the bowling ball. Liquid on the surface of the bowling ball may thereafter be removed.

5 Claims, 3 Drawing Sheets

BOWLING BALL REJUVENATOR

BACKGROUND OF THE INVENTION

1. Field of the Invention

The present invention is directed to an apparatus to extract liquid that has been absorbed into a bowling ball. In particular, the present invention is directed to extract liquid absorbed in a bowling ball by heating the bowling ball in a closed chamber to increase the temperature of the ball so that liquid within the ball moves to the surface of the bowling ball.

2. Prior Art

In the sport of bowling, both the condition of the bowling lane and the bowling ball have an impact on the results obtained. The bowling lane itself is typically made of wood which requires a permanent finish of lacquer or polymer. The lane is approximately 63 feet long from the foul lane, is between 41 and 42 inches wide and is constructed of a series of thin boards. A hardwood, such as maple, is used on the first 15 feet and also for the last 6 or 7 feet. In between, a softer wood, such as pine, is used. The softer and rougher grained pine favors friction with the ball.

In addition to the permanent finish, an oil is regularly applied to the lanes as a top coating. This top coating or dressing is applied in various patterns. The reported results of this dressing are somewhat anecdotal, are the subject of much discussion and are considered "an art" in the field of bowling. Various patterns of top dressing are employed. As an example, dressing may be applied evenly all the way down the lane. The dressing may be tapered so that heavy oil is applied in the center of the lane and a light oil on the edges. Alternately, the heavy oil may be applied at the edges with no oil in the center. Various combinations of these may be employed. The term "carrydown" refers to the migration of the oil on the lane downward from use.

The "hook" or curve of the ball as it travels down the lane is important to bowlers. The angle of entry of the ball as it strikes the pins influences the results. In order for the ball to "hook", friction must develop between the moving ball and the lane. The more top dressing applied, the less friction between the ball and lane and the less that the ball will hook.

Additionally, the bowling ball is also a factor in the travel of the ball and its "hook". As an example, a sixteen pound ball has been found to develop about 2500 pounds of force per square inch as it contacts the lane surface. Besides the circumferential size and the weight of the ball, the surface of the ball plays a factor. With a ball having a harder surface, less friction will develop with the lane and the ball will skid. Conversely, a porous ball will produce more friction with the lane. The greater the friction, the greater the ability to curve or hook the ball.

From about the turn of the century until about 1960, bowling balls were made from hard rubber. Today, many of the bowling balls are manufactured from resins. The coverstock, or outer ¾ to ⅞ inch, is composed of a urethane resin while the core is composed of a plastic resin that does not absorb liquid.

It has been found that the dressing or oil from the lanes will be absorbed from the surface into the coverstock of the bowling ball. Depending on the conditions, the bowling ball will absorb a significant amount of oil after as few as five games. This is particularly true with the more porous balls which are sometimes known as reactive resin balls and have a tacky surface. It has been found that once the coverstock is soaked with oil, oil remains on the surface of the ball. This leads to the incongruous result that a porous ball chosen for its ability to grip the lane will absorb oil that decreases friction.

Various machines have been proposed in the past to wipe off dirt and oil from the surface of the ball. These machines vary from air blowing on the ball to wiping down the ball with brushes or rags. Shibuya (U.S. Pat. No. 3,758,912), Worsham (U.S. Pat. No. 5,373,597) and Knepper (U.S. Pat. No. 4,192,034) show examples of ball cleaners. Nevertheless, no treatment has been proposed beyond the surface wiping or brushing of the ball.

Alternatively, sanding and resurfacing of the ball is sometimes performed in an effort to maintain the friction with the lane.

It is, therefore, a principal object and purpose of the present invention to extract liquid that has been absorbed into the surface of a bowling ball.

It is a further object and purpose of the present invention to extract liquid that has been absorbed in the bowling ball by applying heat to the bowling ball so that liquid molecules will expand and work their way toward the surface.

It is a further object and purpose to remove liquid that has gathered on the surface of the ball after heating.

Alternatively, the bowling ball may hook too much and it may be desirable to decrease the friction between the ball and the lane by introducing oil to the surface of the ball.

Accordingly, it is a further object and purpose of the present invention to introduce liquid that is absorbed into the coverstock of the bowling ball.

SUMMARY OF THE INVENTION

The present invention is directed to an apparatus and a process to extract liquid absorbed into a bowling ball. The apparatus includes a cabinet supported on legs and a closed chamber to receive the bowling ball. The chamber is insulated to retain heat and includes a door having a handle, a latch and hinges.

A heating element is located within the cabinet. Juxtaposed between the heating element and the bowling ball is a heat deflector plate having a series of openings or perforations to deflect a portion of the heat and distribute it more evenly through the closed chamber.

A cup or other platform receives and supports the bowling ball. A shaft extends from the base of the cup and through the closed chamber and cabinet. The terminal end of the shaft is engaged with a motor which rotates the shaft and, in turn, rotates the cup. The bowling ball is thus rotated by action of the motor.

The heating element is connected to a thermostat having a thermometer inside the closed chamber which monitors the temperature within the chamber and activates and deactivates the heating element.

Application of heat to the bowling ball will cause liquid within the bowling ball to move toward the surface and bead up into liquid droplets on the surface of the bowling ball.

The liquid droplets on the surface may be removed in a number of ways. The ball may be manually removed from the chamber and wiped down with a rag or other absorbent item. Alternatively, an arcuate or curved wiper conforming to and engaging the surface of the ball may be provided in the closed chamber. As the bowling ball rotates by force of the motor, the stationary wiper will remove liquid droplets on the surface. As a further alternate means of removing liquid from the surface of the ball, a vacuum force may be supplied in the closed chamber directed through a curved wand close to the surface of the bowling ball.

DETAILED DESCRIPTION OF THE PREFERRED EMBODIMENTS

Figure 1:
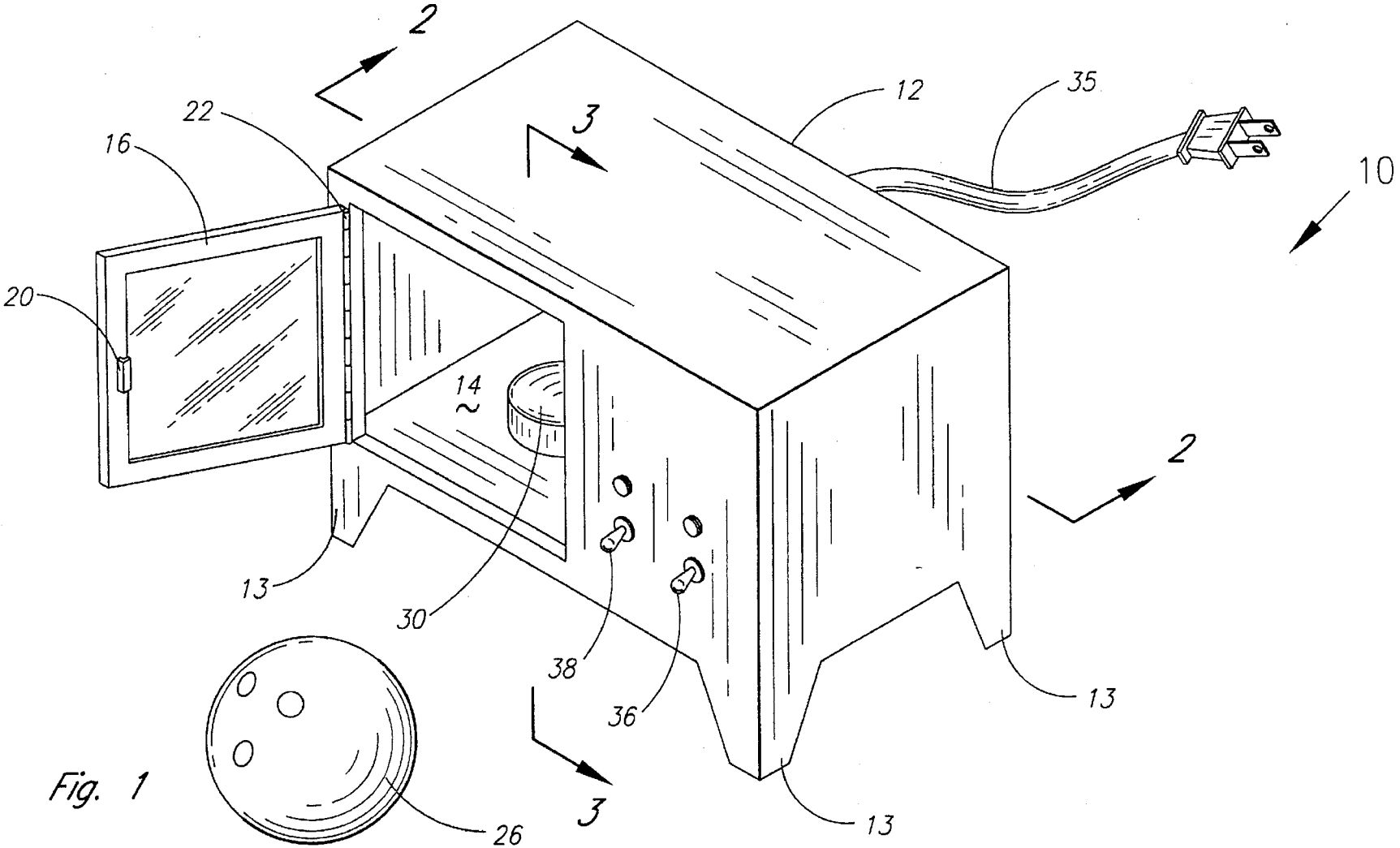
FIG. 1 is a perspective view of an apparatus to extract liquid absorbed into a bowling ball constructed in accordance with the present invention with the door of the apparatus open and a bowling ball outside of the apparatus.

Referring to the drawings in detail, FIG. 1 illustrates an apparatus 10 to extract liquid absorbed into a bowling ball. The apparatus 10 includes a cabinet 12 constructed of a sturdy, heat-resistant material such as aluminum. The cabinet 12 is supported on legs 13 and includes a closed chamber 14 which is larger in size than a bowling ball. The closed chamber 14 is insulated to retain heat therein and also includes a door 16 having a handle 18 and a latch 20. The door is attached to the cabinet 12 by hinges 22 so that the door 16 may be opened to insert a bowling ball and closed during the heating process to be described in detail herein.

Figure 2:
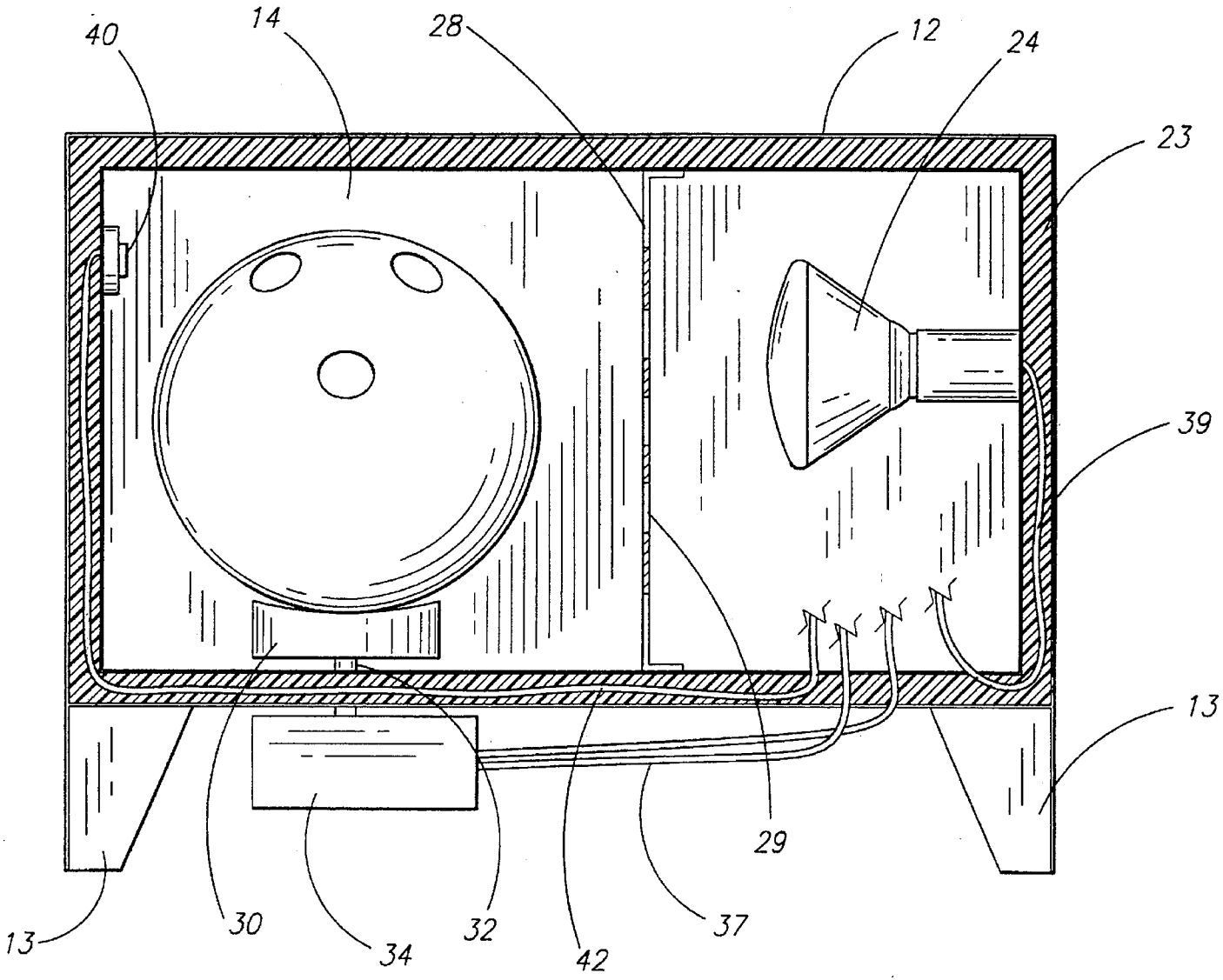
FIG. 2 is a sectional view of the apparatus shown in FIG. 1 taken along section line 2—2 of FIG. 1 with a bowling ball inside the apparatus.

FIG. 2 is a sectional view taken along section line 2—2 of FIG. 1. A layer of insulation 23 in the closed chamber assists in retaining heat within the closed chamber. A heating element, in the present embodiment an infrared lamp 24, is located within the cabinet 12. While an infrared lamp is utilized in the present embodiment, it will be understood that other heat sources might be employed.

Figure 3:
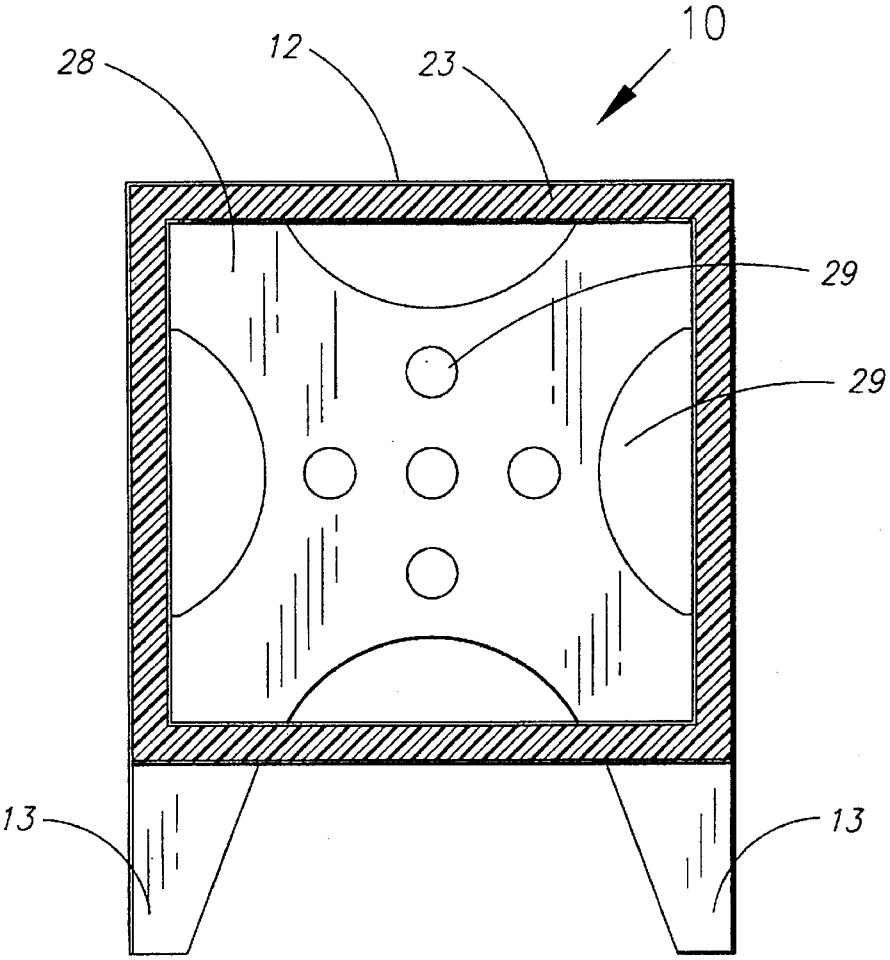
FIG. 3 is a sectional view taken along section line 3—3 of FIG. 1.

As seen in FIG. 2, a spherical bowling ball 26 has been inserted into the closed chamber 14. The bowling ball typically includes a urethane resin coverstock although balls of other construction might be used. The lamp 24 is aimed toward the bowling ball 26. Juxtaposed between the lamp 24 and the bowling ball 26 is a heat deflector plate 28 which has a series of openings or perforations 29 therein. The heat deflector plate 28, which is best seen in the sectional view in FIG. 3, deflects a portion of the heat emanating from the lamp 24 and distributes it more evenly throughout the closed chamber 14.

A cup 30 or other platform is used to receive and support the bowling ball 26. A shaft 32 extends from the base of the cup 30 and through both the closed chamber 14 and cabinet 12. The terminal end of the shaft 32 is engaged with an electric motor 34 which rotates the shaft 32 and, in turn, rotates the cup 30. Accordingly, the bowling ball 26 is also rotated by the action of the motor. In the present embodiment, the electric motor 34 is geared down so that it rotates the bowling ball 26 slowly, approximately six revolutions per minutes. This also assists in uniformly heating the bowling ball 26 with the lamp 24.

The motor 34 is wired to standard electric service through a cord 35 (seen in FIG. 1) and passes through a switch 36 on the front of the cabinet 12 to activate and deactivate the motor. The motor 34 is connected to the switch 36 through wires 37.

The heat lamp 24 is also powered by standard electrical service through cord 35. A heat switch 38 connected to the lamp through wire 39 will be used to activate and to deactivate the heating element. A thermostat having a thermometer 40 inside of the closed chamber 14 monitors the temperature within the chamber. The thermostat is wired to the lamp switch 38 via wires 42 so that the heating element 24 will be turned off when the temperature exceeds a certain desired set point.

As the liquid is extracted from the bowling ball 26, it will bead up into liquid droplets on the surface of the bowling ball. It is thereafter desirable to remove the liquid droplets from the surface of the ball 26. This may be accomplished in a number of ways. The ball 26 may be manually removed from the closed chamber 14 through the open door 16 and then wiped down with a rag or other absorbent item.

Figure 4:
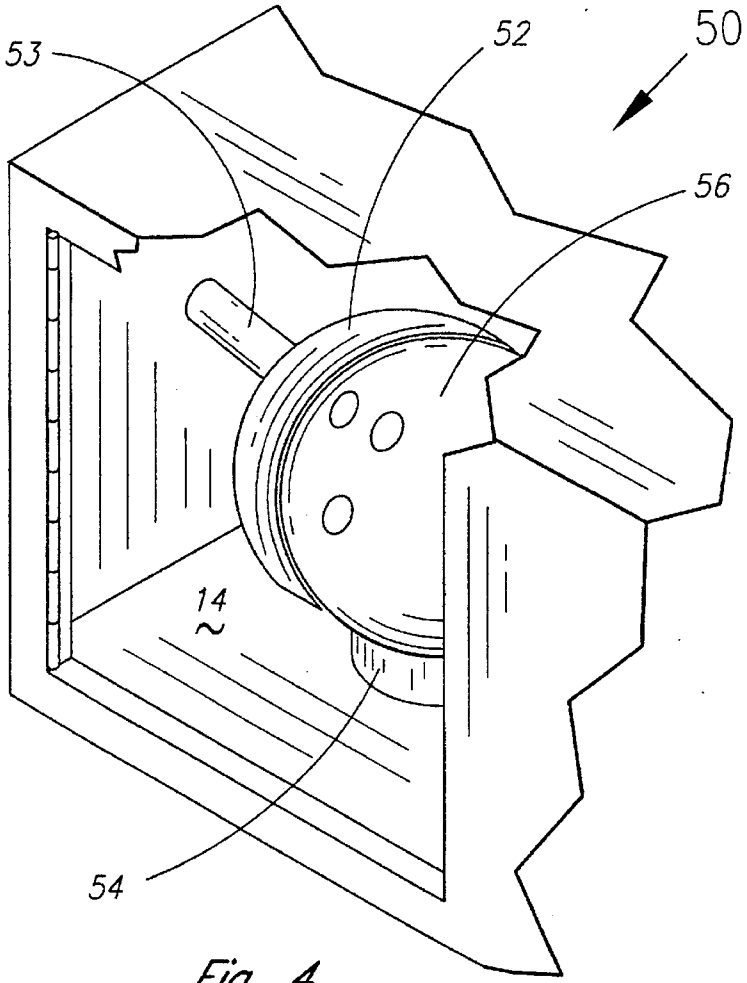
FIG. 4 is a partial, cutaway view of an alternate embodiment of an apparatus to extract liquid absorbed into a bowling ball.

An alternate embodiment 50 is depicted in FIG. 4. It is also possible to remove the liquid from the surface of the ball by including an arcuate or curved wiper 52 which would conform to and engage the surface of the ball when in the cup. The wiper 52 extends from an arm 53 which is connected to the apparatus. The bowling ball would be supported by a cup 54 in the chamber. As the bowling ball 56 rotates by force of the motor on the shaft, the ball will move and the wiper 52 will remain stationary. Any liquid droplets on the surface of the ball will thus be removed by the wiper 52.

In a further alternate means 58 of removing the liquid from the surface of the ball, a vacuum force is supplied in the closed chamber. Similarly, a cabinet would include a closed chamber 14 to receive a bowling ball. The vacuum may be directed to curved wand (60) conforming to and engaging the surface of the ball. Again, rotation of the ball will allow the vacuum mechanism to suck away oil on substantially all the surface of the bowling ball. To facilitate rotation of the ball, the vacuum mechanism should be positioned close to, but not touching, the ball.

To utilize the apparatus 10, a series of discrete steps are undertaken. Initially, the door 16 of the closed chamber 14 is opened and the bowling ball 26 is placed within the closed chamber supported by the cup 30. Thereafter, the door 16 is closed.

The motor switch 36 to start the motor 34 causes the ball to rotate slowly in the closed chamber 14. Additionally, activating the heat switch 38 which controls the thermostat and lamp will cause the lamp 24 to turn on and the chamber to begin increasing in temperature. The thermostat will be set so that the chamber 14 will heat to approximately 150° F. While too high a temperature will cause polymers in the coverstock to be altered, it has been found that a temperature between 100° and 180° F. will cause any liquid absorbed in the ball 26 to move to the surface.

In one process in accordance with the present invention, the ball 26 is heated in the chamber to a temperature of 150° F. and retained for a minimum of ten minutes. Other temperatures within the temperature range might be employed. This causes droplets or beads of oil to accumulate on the surface. Thereafter, the liquid is removed or wiped from the surface of the ball. The bowling ball is then placed back in the chamber 14 and the heating process repeated for approximately five minutes at 150° F. Any remaining oil within the ball 26 will move to the surface of the ball. Finally, the ball 26 is again wiped down and any liquid molecules removed from the surface of the ball.

In an alternate procedure, the bowling ball is heated and the liquid droplets on the surface of the ball are removed while the ball is within the closed chamber 14. Using the alternate embodiment shown in FIG. 4, a stationary wiper 52 engages the surface of the ball.

It has been observed through repeated tests that heating of bowling balls in this manner causes any liquid in the balls to move to the surface. Applicant has speculated as to the reasons for this phenomenon. It is not believed that the oil or other liquid chemically reacts with the coverstock or attaches to the polymers of the resin. Rather, the oil is believed to soak into the pores of the resin. The liquid droplets may conduct heat better than the urethane resin and the thermal expansion of the liquid may be greater than the solid. Accordingly, the liquid droplets seek greater space.

The present invention may be used in a reverse procedure. In those cases in which too much friction develops between the bowling ball 26 and the bowling lane, it may be desirable to impart a certain amount of oil to the surface of the ball. In this procedure, the ball will be placed into the closed chamber and heated for a period of time. After heating, the ball is then rubbed down with a rag or other material containing oil so that a certain amount of oil is imparted to the surface of the ball. As the ball cools, it has been observed that the oil will soak into and reside within the ball in the cover stock beneath the surface. In this condition, a certain amount of the oil remains on the surface of the ball and decreases the friction between the ball surface and the lane as the ball travels.

Whereas, the present invention has been described in relation to the drawings attached hereto, it should be understood that other and further modifications, apart from those shown or suggested herein, may be made within the spirit and scope of this invention.

What is claimed is:

1. An apparatus to extract liquid absorbed in a bowling ball having a surface, which apparatus comprises:

a closed chamber to receive said bowling ball therein, said closed chamber comprising an inner surface; and a heating element in said chamber to increase the temperature of said ball to a temperature above ambient room temperature sufficient to draw said liquid to said surface of said bowling ball, and removal means to remove said liquid from said ball surface, said removal means positioned within said closed chamber spaced from said chamber inner surface, said removal mean proximate to said ball surface.

2. An apparatus to extract liquid absorbed in a bowling ball as set forth in claim 1 flat heat deflector plate juxtaposed between said heating element and said ball.

3. An apparatus to extract liquid absorbed in a bowling ball having a surface, which apparatus comprises:

a closed chamber to receive said bowling ball therein;

a heating element in said chamber to increase the temperature of said ball to a temperature above ambient room temperature sufficient to draw said liquid to said surface of said bowling ball; and means to remove said liquid from said surface of said ball, wherein said removal means includes at least one arcuate wiper positioned within said closed chamber, said removal means proximate to said surface of said ball.

4. An apparatus to extract liquid absorbed in a bowling ball having a surface, which apparatus comprises:

a closed chamber to receive said bowling ball therein;

a heating element in said chamber to increase the temperature of said ball to a temperature above ambient temperature sufficient to draw said liquid to said surface of said bowling ball;

means to remove said liquid from said surface of said ball, said removal means positioned within said closed chamber, said removal means proximate to said ball surface, said removal means including a vacuum.

5. An apparatus to extract liquid absorbed in a bowling ball having a surface, which apparatus comprises:

a closed chamber to receive said bowling ball therein;

a heating element in said chamber to increase the temperature of said ball to a temperature above ambient temperature sufficient to draw said liquid to said surface of said bowling ball;

a cup in said closed chamber to receive said ball, a shaft extending from said cup, and a motor to rotate said shaft; and a stationary, circumferential wiper engaging said surface of said ball to remove liquid gathered on said surface.

* * * * *